US010072798B2

(12) United States Patent
Herry et al.

(10) Patent No.: US 10,072,798 B2
(45) Date of Patent: Sep. 11, 2018

(54) SEALED AND INSULATING VESSEL COMPRISING A BRIDGING ELEMENT BETWEEN THE PANELS OF THE SECONDARY INSULATION BARRIER

(71) Applicant: GAZTRANSPORT ET TECHNIGAZ, Saint Remy les Chevreuse (FR)

(72) Inventors: Mickael Herry, Massy (FR); Marc Boyeau, Viroflay (FR); Bruno Deletre, Versailles (FR); Antoine Philippe, Gif sur Yvette (FR)

(73) Assignee: GAZTRANSPORT ET TECHNIGAZ (FR)

( * ) Notice: Subject to any disclaimer, the term of this patent is extended or adjusted under 35 U.S.C. 154(b) by 0 days.

(21) Appl. No.: 15/514,236

(22) PCT Filed: Sep. 22, 2015

(86) PCT No.: PCT/FR2015/052535

§ 371 (c)(1),
(2) Date: Mar. 24, 2017

(87) PCT Pub. No.: WO2016/046487

PCT Pub. Date: Mar. 31, 2016

(65) Prior Publication Data

US 2017/0276295 A1 Sep. 28, 2017

(30) Foreign Application Priority Data

Sep. 26, 2014 (FR) ..... 14 59160

(51) Int. Cl.
*F17C 3/02* (2006.01)
*B63B 25/08* (2006.01)

(52) U.S. Cl.
CPC ..... *F17C 3/027* (2013.01); *B63B 25/08* (2013.01); *F17C 2201/0157* (2013.01);
(Continued)

(58) Field of Classification Search
CPC . B63B 25/08; B63B 25/16; F17C 3/00; F17C 3/02; F17C 3/025; F17C 3/027;
(Continued)

(56) References Cited

U.S. PATENT DOCUMENTS 3,341,050 A 9/1967 Forman et al.
6,035,795 A * 3/2000 Dhellemmes ..... B63B 25/16 114/74 A

FOREIGN PATENT DOCUMENTS

FR 2996520 A1 4/2014
JP H0899689 A 4/1996
(Continued)

OTHER PUBLICATIONS

International Search Report with regard to PCT/FR2015/052535 dated Feb. 8, 2016.
(Continued)

*Primary Examiner* — Lars A Olson
(74) *Attorney, Agent, or Firm* — Blank Rome LLP

(57) ABSTRACT

The invention concerns a sealed and thermally insulating vessel for storing a fluid, comprising a secondary thermal insulation barrier and a secondary sealing membrane, the secondary sealing membrane comprising a plurality of corrugated metal sheets sealingly welded to each other and each comprising at least two perpendicular corrugations, the secondary thermal insulation barrier comprising a plurality of juxtaposed insulating panels, each insulating panel having an inner face, opposite the bearing wall, provided with metal plates to which the corrugated metal sheets are welded, each insulating panel being associated with the adjacent insulating panels via a plurality of bridging elements.

19 Claims, 13 Drawing Sheets

(52) U.S. Cl.
CPC ..... *F17C 2201/052* (2013.01); *F17C 2203/0358* (2013.01); *F17C 2203/0631* (2013.01); *F17C 2203/0643* (2013.01); *F17C 2203/0646* (2013.01); *F17C 2203/0651* (2013.01); *F17C 2221/033* (2013.01); *F17C 2223/0161* (2013.01); *F17C 2223/033* (2013.01); *F17C 2260/011* (2013.01); *F17C 2270/0107* (2013.01); *F17C 2270/0113* (2013.01)

(58) Field of Classification Search
CPC ..... F17C 3/04; F17C 3/06; F17C 6/00; F17C 9/00; F17C 13/00; F17C 13/001; B65D 90/06; B65D 90/08
USPC ..... 114/74 A, 74 R; 220/560.04, 560.11, 220/560.12, 901, 902
See application file for complete search history.

(56) References Cited

FOREIGN PATENT DOCUMENTS

| | | | |
|---|---|---|---|
| JP | 2006017213 | A | 1/2006 |
| JP | 2006137421 | A | 6/2006 |
| JP | 2006300320 | A | 11/2006 |
| JP | 2013167327 | A | 8/2013 |
| JP | 2014520702 | A | 8/2014 |
| JP | 2014521024 | A | 8/2014 |
| WO | 2007064212 | A1 | 6/2007 |
| WO | 2008147003 | A1 | 12/2008 |
| WO | 2013017773 | A2 | 2/2013 |
| WO | 2014057221 | A2 | 4/2014 |

OTHER PUBLICATIONS

English Abstract of FR2996520 retrieved on Espacenet on Mar. 20, 2017.
Japanese Office Action with regard to the counterpart patent application JP2017-515802 dated Dec. 12, 2017 and English Translation.
English Abstract for JPH0899689 retrieved on Espacenet on Mar. 31, 2018.
English Abstract for JP2014520702 retrieved on Espacenet on Mar. 31, 2018.
English Abstract for JP2014521024 retrieved on Espacenet on Mar. 31, 2018.
English Abstract for JP2006137421 retrieved on Espacenet on Mar. 31, 2018.
English Abstract for JP2013167327 retrieved on Espacenet on Mar. 31, 2018.
English Abstract for JP2006300320 retrieved on Espacenet on Mar. 31, 2018.
English Abstract for JP200617213 retrieved on Espacenet on Apr. 3, 2018.

* cited by examiner

SEALED AND INSULATING VESSEL COMPRISING A BRIDGING ELEMENT BETWEEN THE PANELS OF THE SECONDARY INSULATION BARRIER

CROSS-REFERENCE

The present application is a National Stage Entry of International Patent Application No. PCT/FR2015/052535 filed on Sep. 22, 2015 and claims priority of the French Patent Application No. 1459160 filed on Sep. 26, 2014 the entire contents of which are incorporated herein by reference.

TECHNICAL DOMAIN

The invention relates to the field of sealed and thermally insulated membrane vessels for storing and/or transporting fluids, such as a cryogenic fluid.

Sealed and thermally insulated membrane vessels are notably used to store liquefied natural gas (LNG), which is stored at atmospheric pressure at around −162° C. These vessels can be installed on land or on floating structures. In a floating structure, the vessel can be used to transport liquefied natural gas or to receive liquefied natural gas used as fuel to power the floating structure.

TECHNOLOGICAL BACKGROUND

Sealed and thermally insulated vessels for storing liquefied natural gas that are built into a load-bearing structure, such as the double hull of a ship used to transport liquefied natural gas are known in the prior art. Such vessels usually have a multi-layer structure having, successively arranged through the thickness of the vessel from the outside towards the inside of the vessel, a secondary thermal insulation barrier attached to the load-bearing structure, a secondary sealing membrane bearing against the secondary thermal insulation barrier, a primary thermal insulation barrier bearing against the secondary sealing membrane and a primary sealing membrane designed to be in contact with the liquefied natural gas contained in the vessel.

Document FR 2996520 describes a secondary sealing membrane formed by a plurality of metal sheets having corrugations projecting towards the outside of the vessel, thereby enabling the secondary sealing membrane to be deformed by the thermal and mechanical stresses generated by the fluid stored in the vessel. The secondary thermal insulation barrier is made up of a plurality of insulation panels juxtaposed against the load-bearing structure. The insulation panels of the secondary thermal insulation barrier are separated by interstices into which the corrugations of the metal sheets of the secondary sealing membrane are inserted. Furthermore, the metal sheets of the secondary sealing membrane are welded to metal plates attached to the inner face of insulation units of the secondary thermal insulation barrier such as to anchor the secondary sealing membrane to the secondary thermal insulation barrier.

When cooling the vessel, i.e. when the vessel is filled with liquefied natural gas, the insulation panels of the secondary thermal insulation barrier tend to retract and, consequently, to move apart from one another. The insulation panels may also move apart from one another as a result of deformation of the double hull of the ship. The separation of the insulation panels of the secondary thermal insulation barrier generates significant stresses on the secondary sealing membrane. Furthermore, such separation stresses the secondary sealing membrane all the more since the latter is sandwiched between the insulation panels of the secondary thermal insulation barrier and the insulation panels of the primary thermal insulation barrier, said separation of the insulation panels causing the secondary sealing membrane to rub against the insulation panels of the primary and secondary thermal insulation barriers.

Document WO2013004943 provides a secondary sealing membrane made up of a plurality of corrugated metal sheets having corrugations projecting towards the outside of the vessel, which is attached to couplings directly connected to the load-bearing structure. Thus, since such a secondary sealing membrane is not attached directly to the insulation panels of the secondary thermal insulation barrier, same is not mechanically affected by the insulation panels moving apart from one another. However, such a design is also unsatisfactory. Indeed, such an attachment of the secondary sealing membrane to couplings only provides sporadic links to the secondary sealing membrane, and as a result same is not stressed uniformly. Furthermore, since the secondary sealing membrane is sandwiched between the insulation panels of the secondary thermal insulation barrier and the insulation panels of the primary thermal insulation barrier, the reciprocal separation of the insulation panels of the secondary thermal insulation barrier nonetheless generates a mechanical stressing of the secondary sealing membrane as a result of the friction caused between same and the insulation panels of the secondary thermal insulation barrier.

Abstract

One idea at the heart of the invention is to propose a sealed and thermally insulated vessel fitted with a secondary sealing membrane comprising a plurality of metal sheets having corrugations, in which said secondary sealing membrane is subjected to low-intensity, uniform stresses, in particular when cooling the vessel.

According to one embodiment, the invention provides a sealed and thermally insulated vessel for storing a fluid, comprising a secondary thermal insulation barrier comprising insulation panels held against a load-bearing structure and anchored to same by secondary retaining members, a secondary sealing membrane carried by the insulation panels of the secondary thermal insulation barrier, a primary thermal insulation barrier anchored against the secondary sealing membrane by primary retaining members and a primary sealing membrane carried by the primary thermal insulation barrier and designed to be in contact with the cryogenic fluid contained in the vessel;

the secondary sealing membrane comprising a plurality of corrugated metal sheets sealingly welded to one another, each having at least two perpendicular corrugations;

the insulation panels of the secondary thermal insulation barrier being juxtaposed, each insulation panel having an inner face opposite the load-bearing wall, said inner face being fitted with metal plates onto which the corrugated metal sheets are welded;

each insulation panel being associated with adjacent insulating panels by means of a plurality of bridging elements, each bridging element being arranged to straddle at least two adjacent insulating panels and being attached firstly to one edge of the inner face of one of the two insulation panels and secondly to a facing edge of the inner face of the other insulation panel such as to prevent the adjacent insulation panels from moving apart from one another.

Thus, the bridging elements provide a mechanical link between the insulation panels of the secondary thermal insulation barrier that prevents the insulation panels from moving apart from one another such that the secondary sealing membrane is less stress than the secondary sealing membranes in vessels in the prior art, in particular when cooling the vessel.

According to the embodiments, such a vessel may have one or more of the following features:

- the edges of the inner faces of each of the adjacent insulating panels that are straddled by a plurality of bridging elements face one another. In other words, said edges of each of the insulation panels are adjacent.
- the corrugations of the corrugated metal sheets of the secondary sealing membrane project towards the outside of the vessel and towards the load-bearing structure, the inner face of the insulation panels of the secondary thermal insulation barrier having perpendicular slots designed to receive the corrugations of the corrugated metal sheets.
- the corrugations of the corrugated metal sheets of the secondary sealing membrane project towards the inside of the vessel, the primary thermal insulation barrier having insulation panels, each of which has an outer face with perpendicular slots designed to receive the corrugations of the corrugated metal sheets of the secondary sealing membrane.
- the bridging elements are bridging plates that each have an outer face bearing against the inner face of each of the adjacent insulation panels and an inner face carrying the secondary sealing membrane.
- the inner face of the insulation panels has recesses formed along the edges of said inner face, and the bridging plates are attached to the inside of said recesses.
- the bridging plates are as thick as the recesses are deep.
- the bridging plates are attached by bonding, screwing and/or stapling against the inner face of each of the two adjacent insulation panels.
- the bridging plates are made of plywood.
- each insulation panel has a rectangular parallelepiped shape and has an inner face including two series of slots designed to receive the corrugations of the corrugated metal sheets, each of the two series of slots being perpendicular to the other series and to two opposite sides of the insulation panel, the plurality of bridging elements including, along each edge of the inner surface of each insulation panel, a bridging element arranged in each gap between two consecutive slots in the series of slots perpendicular to said edge.
- each insulation panel has a rectangular parallelepiped shape and has an inner face including two series of slots designed to receive the corrugations of the corrugated metal sheets, each of the two series of slots being perpendicular to the other series and to two opposite sides of the insulation panel, the plurality of bridging elements including, along each edge of the inner surface of each insulation panel, a bridging element having a series of slots extending the series of slots perpendicular to said edge.
- the bridging element comprising a series of slots extending the series of slots perpendicular to said edge also includes a slot perpendicular to said series of slots.
- the secondary thermal insulation barrier has a bridging element at each corner of the inner face of each insulation panel straddling said corner of said insulation panel and the neighboring corner of the inner face of each of the two or three adjacent insulation panels.
- a bridging element includes an elongate element, such as a wire or a flexible blade element, that is rigidly attached to two attachment members attached respectively to each of the two adjacent insulation panels.
- a bridging element is formed by two metal plates each having a folded edge forming a flange, the flanges being respectively held inside a slot formed in the inner face of each of the two adjacent panels, the two metal plates being attached together by attachment members.
- each insulation panel has a layer of insulating polymer foam and a rigid inner plate forming the inner face of said insulation panel.
- the insulating panels are separated from one another by interstices, the secondary thermal insulation barrier having an insulating blanket arranged in the interstices.
- the insulating blanket arranged in the interstices between the insulation panels is a porous blanket designed to allow gas to flow through the interstices.
- the primary sealing membrane has a plurality of corrugated metal sheets welded to one another and each having at least two perpendicular corrugations projecting towards the inside of the vessel and the primary thermal insulation barrier has a plurality of juxtaposed insulation panels, each insulation panel having an inner face fitted with metal plates onto which the corrugated metal sheets of the primary sealing membrane are welded.

Such a vessel may be part of an onshore storage facility, for example for storing LNG, or be installed on a coastal or deep-water floating structure, notably a liquefied natural gas carrier, an ethane carrier, a floating storage and regasification unit (FSRU), a floating production, storage and offloading (FPSO) unit, inter alia.

According to one embodiment, a ship used to transport a cold liquid product has a double hull and the aforementioned vessel arranged in the double hull.

According to one embodiment, the invention also provides a method for loading onto or offloading from such a ship, in which a fluid is channeled through insulated pipes to or from an onshore or floating storage facility to or from the vessel on the ship.

According to one embodiment, the invention also provides a transfer system for a fluid, the system including the aforementioned ship, insulated pipes arranged to connect the vessel installed in the hull of the ship to an onshore or floating storage facility and a pump for driving a fluid through the insulated pipes to or from the onshore or floating storage facility to or from the vessel on the ship.

SHORT DESCRIPTION OF THE FIGURES

The invention is further explained, along with additional objectives, details, features and advantages thereof, in the detailed description below of several specific embodiments of the invention given solely as non-limiting examples, with reference to the drawings attached.

DETAILED DESCRIPTION OF THE EMBODIMENTS

By convention, the terms "outer" and "inner" are used to determine the relative position of one element in relation to another, with reference to the inside and the outside of the vessel.

Figure 1:
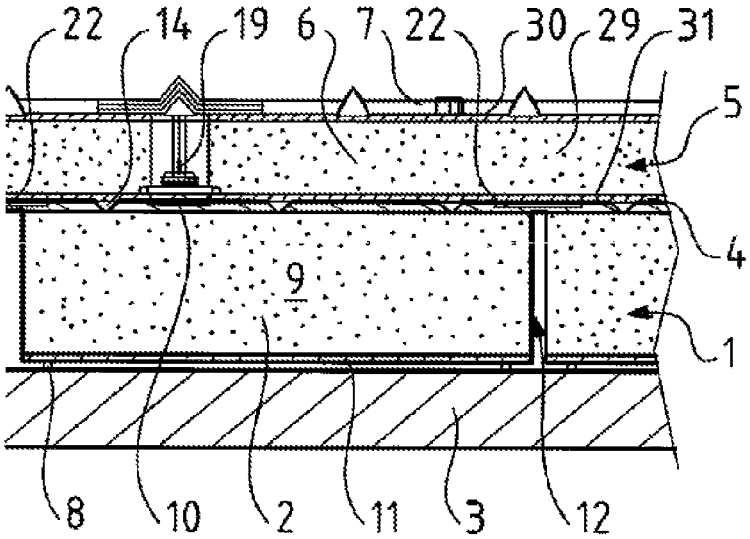
FIG. 1 is a cross section of a wall of a sealed and thermally insulated vessel for storing a fluid.
Figure 2:
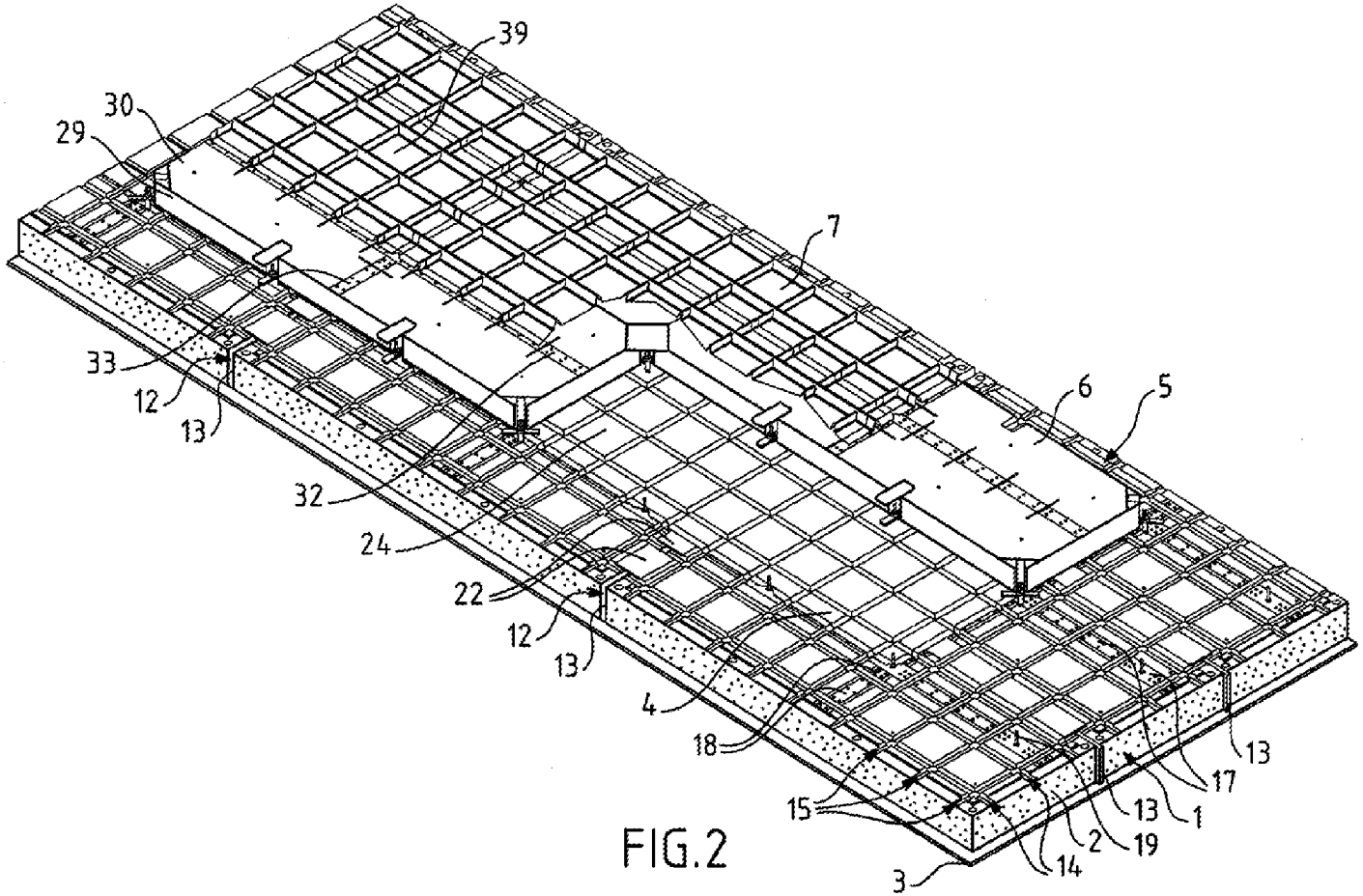
FIG. 2 is a perspective cut-away view of a vessel wall.

FIGS. 1 and 2 show the multi-layer structure of a sealed and thermally insulated vessel for storing a fluid.

Each wall of the vessel includes, from the outside towards the inside of the vessel, a secondary thermal insulation barrier 1 comprising juxtaposed insulation panels 2 anchored to a load-bearing structure 3 by secondary retaining members 8, a secondary sealing membrane 4 carried by the insulation panels 2 of the secondary thermal insulation barrier 1, a primary thermal insulation barrier 5 including juxtaposed insulation panels 6 anchored to the insulation panels 2 of the secondary thermal insulation barrier 1 by primary retaining members 19 and a primary sealing membrane 7 carried by insulation panels 6 of the primary thermal insulation barrier 5 and designed to be in contact with the cryogenic fluid contained in the vessel.

The load-bearing structure 3 may notably be a self-supporting metal sheet or, more generally, any type of rigid partition having appropriate mechanical properties. The load-bearing structure 3 may notably be formed by the hull or the double hull of a ship. The load-bearing structure 3 comprises a plurality of walls defining the general shape of the vessel, which is usually polyhedral.

The secondary thermal insulation barrier 1 has a plurality of insulation panels 2 anchored to the load-bearing structure 3 using resin cords (not shown) and/or studs 8 welded to the load-bearing structure 3. The resin cords need to be sufficiently adhesive if they are used alone to anchor the insulation panels 2, but need not be adhesive if the insulation panels 2 are anchored using the studs 8. The insulation panels 2 are substantially rectangular parallelepipeds.

Figure 3:
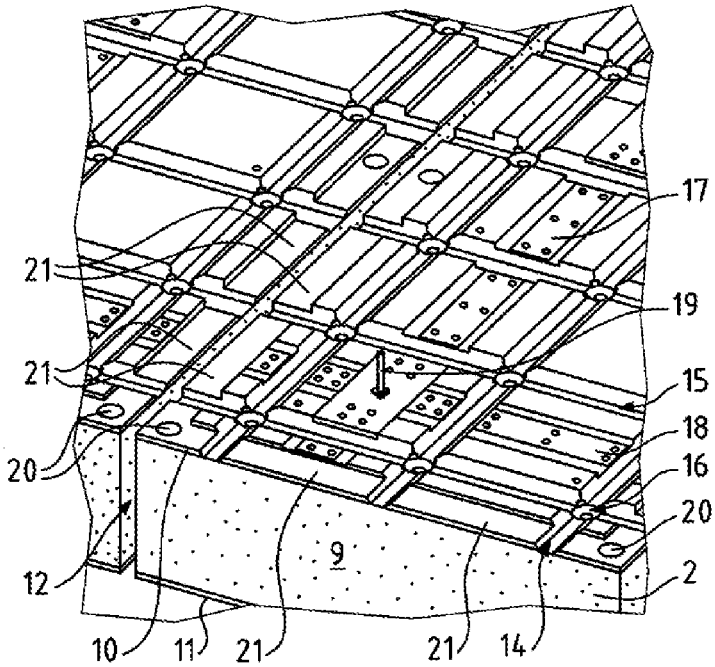
FIG. 3 is a partial perspective view of insulation panels of the secondary thermal insulation barrier before positioning of bridging elements straddling adjacent insulation panels.
Figure 5:
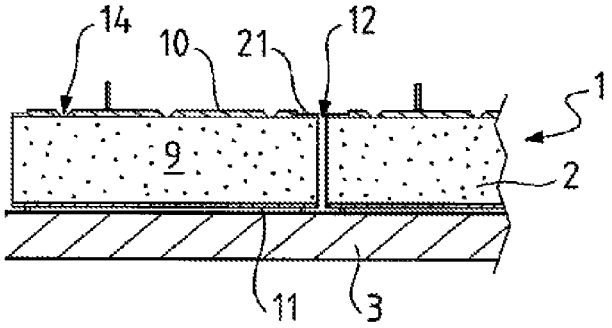
FIG. 5 is a partial cross section of the vessel wall in FIG. 1 showing the secondary thermal insulation barrier before positioning of bridging elements.
Figure 6:
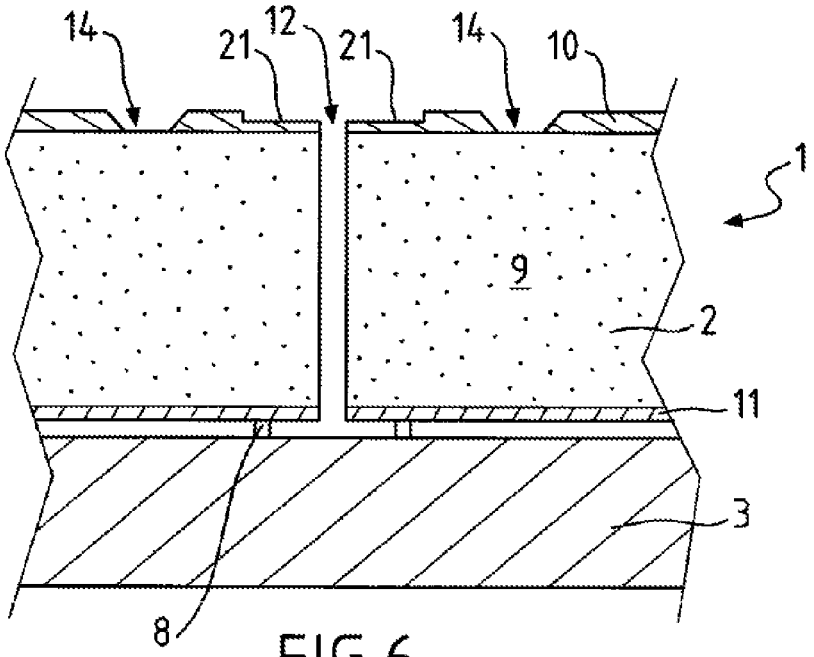
FIG. 6 is a detailed view of the secondary thermal insulation barrier in FIG. 5 around and interstice between two adjacent panels.

As shown notably in FIGS. 3, 5 and 6, each insulation panel 2 has a layer of insulating polymer foam 9 sandwiched between a rigid inner plate 10 and a rigid outer plate 11. The inner and outer rigid plates 10, 11 are for example plywood plates bonded to said layer of insulating polymer foam 9. The insulating polymer foam may notably be a polyurethane-based foam. The polymer foam is advantageously reinforced using glass fibers, thereby helping to reduce the thermal contraction of same.

The insulation panels 2 are juxtaposed in parallel rows separated from one another by interstices 12 providing assembly clearance. The interstices 12 are filled with an insulating blanket 13, shown in FIGS. 2 and 8, made of glass wool, mineral wool or open-cell soft synthetic foam, for example. The insulating blanket 13 is advantageously made of a porous material such as to leave spaces in the interstices 12 between the insulation panels 2 to enable gas flow. Such gas-flow spaces are advantageously used to enable the flow of an inert gas, such as nitrogen, inside the secondary thermal insulation barrier 1 such as to maintain same in an inert atmosphere and thus to prevent the combustible gas from entering an explosive concentration range, and/or to place the secondary thermal insulation barrier 1 under negative pressure to increase the insulation capacity of same. This gas flow is also important to facilitate detection of potential leaks of combustible gas. The interstices 12 are for example around 30 mm wide.

Figure 4:
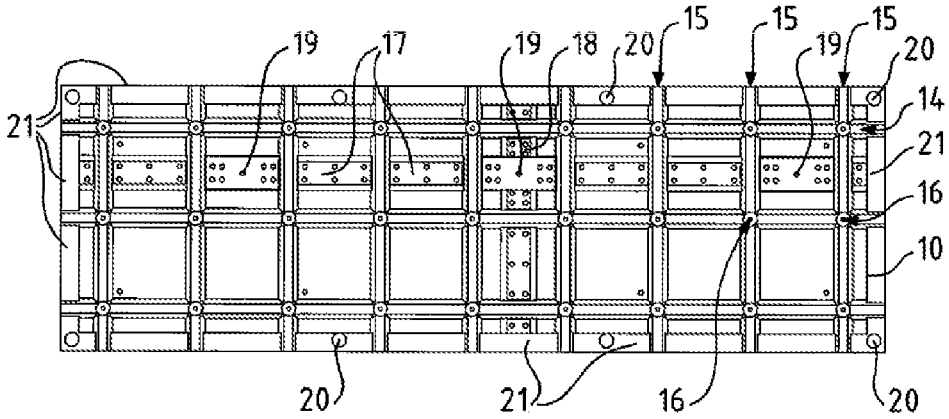
FIG. 4 shows the inner face of an insulation panel of the secondary thermal insulation barrier.

An inner plate 10 according to one embodiment is shown in detail in FIGS. 3 and 4. The inner plate 10 has two series of slots 14, 15 that are perpendicular to one another, such as to form a network of slots. Each series of slots 14, 15 is parallel to two opposing sides of the insulation panels 2. The slots 14, 15 are designed to receive corrugations projecting towards the outside of the vessel and formed on the metal sheets of the secondary sealing barrier 4. In the embodiment shown, the inner plate 10 has three slots 14 extending along the length of the insulation panel 2 and nine slots 15 extending across the insulation panel 2.

The slots 14, 15 pass through the entire thickness of the inner plate 10 and thus open out into the layer of insulating polymer foam 9. Furthermore, the insulation panels 2 have, in the crossing zones between the slots 14, 15, clearance orifices 16 formed in the layer of insulating polymer foam 9. The clearance orifices 16 accommodate the node zones formed at the intersections between the corrugations of the metal sheets of the secondary sealing barrier 4. These node zones, described in greater detail below, have an apex projecting towards the outside of the vessel.

Furthermore, the inner plate 10 is fitted with metal plates 17, 18 to anchor the edge of the corrugated metal sheets of the secondary sealing membrane 4 to the insulation panels 2. The metal plates 17, 18 extend in two perpendicular directions that are each parallel to two opposing sides of the insulating panels 2. The metal plates 17, 18 are attached to the inner plate 10 of the insulation panel 2 using screws, rivets or staples, for example. The metal plates 17, 18 are positioned in recesses formed in the inner plate 10 such that the inner surface of the metal plates 17, 18 is flush with the inner surface of the inner plate 10.

The inner plate 10 is also provided with threaded studs 19 projecting towards the inside of the vessel and designed to attach the primary thermal insulation barrier 5 to the insulation panels 2 of the secondary thermal insulation barrier 1. The metal studs 19 pass through the orifices formed in the metal plates 17.

Furthermore, in order to attach the insulation panels 2 to the studs 8 attached to the load-bearing structure 3, the insulation panels 2 are provided with cylindrical holes 20, shown in FIGS. 3 and 4, that pass through the entire thickness of the insulation panels 2. The cylindrical holes 20 have a change of section (not shown) creating bearing surfaces for the nuts cooperating with the threaded ends of the studs 8. According to one embodiment, the change of section in the cylindrical holes 20 occurs between the outer plate 11 and the layer of insulating polymer foam 9. Thus, the nuts cooperating with the threaded ends of the studs 8 bear against a bearing surface formed by the outer plate 11. In other words, the insulation panels are held on the load-bearing structure by the outer plates 11 of same.

Furthermore, the inner plate 10, along the edges of same and in each gap between two successive slots 14, 15, has a recess 21 designed to receive a bridging element.

Figure 7:
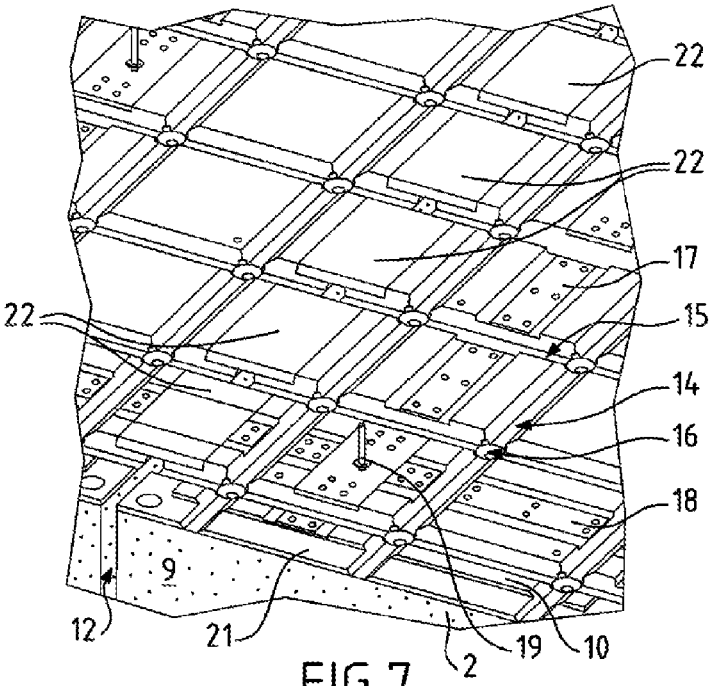
FIG. 7 is a partial perspective view of two adjacent insulation panels of the secondary thermal insulation barrier showing the positioning of bridging elements straddling two adjacent insulation panels.
Figure 8:
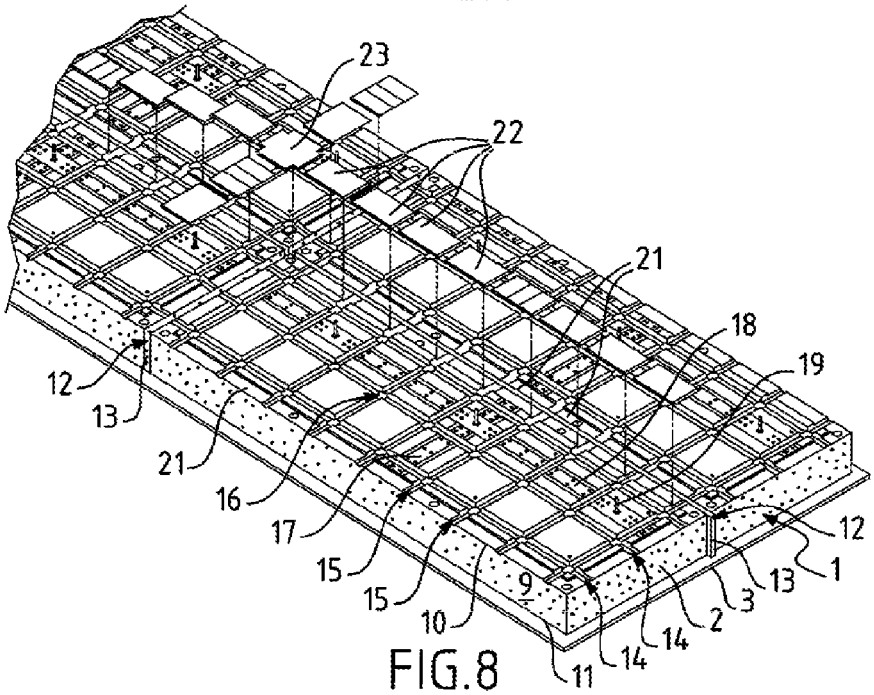
FIG. 8 is an exploded perspective view of insulation panels of the secondary thermal insulation barrier and bridging elements designed to straddle two adjacent insulation panels.
Figure 9:
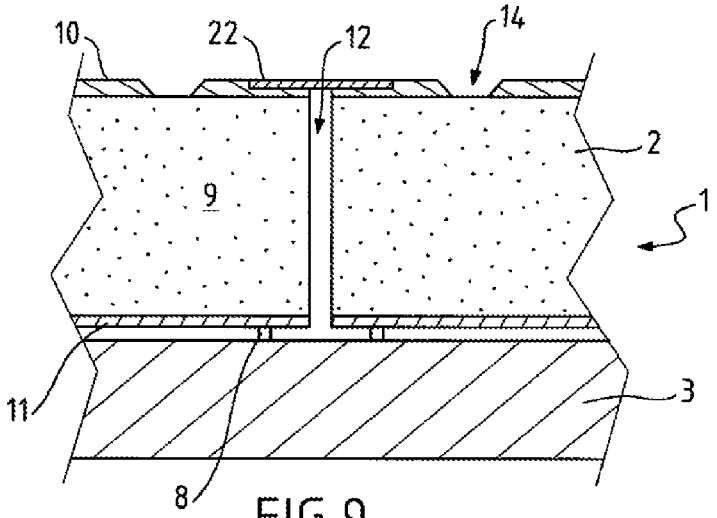
FIG. 9 is a detailed view of the secondary thermal insulation barrier around an interstice between two adjacent insulation panels.

These bridging elements are notably shown in FIGS. 7, 8 and 9. In these figures, the bridging elements are bridging plates 22 that each straddle two adjacent insulation panels 2, spanning the interstice 12 between the insulation panels 2. Each bridging plate 22 is attached against each of the two adjacent insulation panels 2 such as to prevent same from moving apart from one another. The bridging plates 22 are rectangular parallelepipeds and are for example plywood plates.

The outer face of the bridging plates 22 is attached to the base of the recesses 21. The depth of the recesses 21 is substantially equal to the thickness of the bridging plates 22, such that the inner face of the bridging plates 22 is substantially level with the other flat zones of the inner plate 10 of the insulation panel. Thus, the bridging plates 22 provide uniformity for carrying the secondary sealing membrane 4.

In order to properly distribute the joining stresses between adjacent panels, a plurality of bridging plates 22 extends along each edge of the inner plate 10 of the insulation panels 2, a bridging plate 22 being arranged in each gap between two neighboring slots 14, 15 of a series of parallel slops.

Advantageously, the bridging plates 22 cover substantially the entire length of the gap between two neighboring slots 14, 15. Furthermore, the transverse dimension of the recesses 21 is such that the bridging plates 22 but against the edge of the recess 21 such as to facilitate the positioning of the bridging plates 22 against the inner surface of the insulation panels 2.

The bridging plates 22 may be attached against the inner plate 10 of the insulation panels 2 using any appropriate means. Nonetheless, it has been observed that the combination of an adhesive applied between the outer face of the bridging plates 22 and the inner plate 10 of the insulation panels 2 and the use of mechanical attachment members, such as staples, enabling the bridging plates 22 to be pressed against the insulation panels 2, is particularly advantageous.

Figure 25:
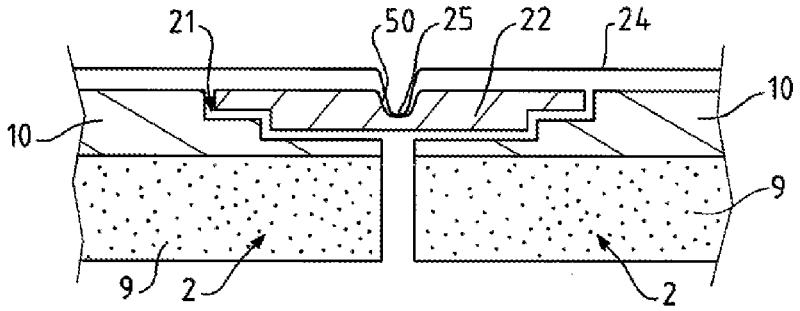
FIG. 25 is a cross section of a bridging element according to a fifth embodiment.
Figure 26:
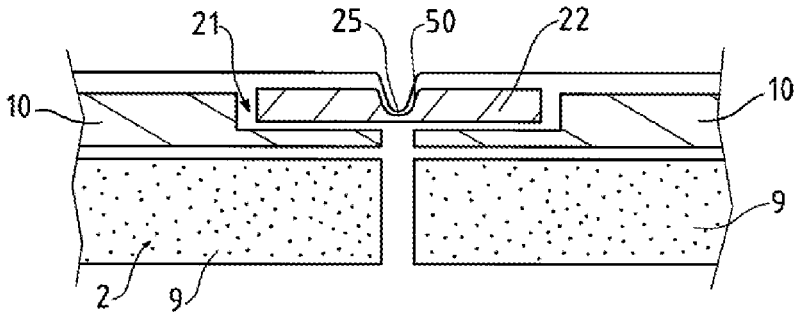
FIG. 26 is a cross section of a bridging element according to a sixth embodiment.

In other embodiments, shown in FIGS. 25 and 26, the bridging plates 22 are provided with slots 50 receiving the corrugations 25, 26 of the corrugated metal sheets 24. In such an embodiment, a bridging plate 22 may extend along the entire length of one edge of the inner surface of an insulation panel 2 and have a series of slots extending the series of slots 14, 15 formed in the inner plates 10 of the adjacent panels 2. Furthermore, the bridging plates 22 may also be provided with a slot 50 extending along the interstice between the two adjacent insulation panels 2 straddled by same.

As shown in FIG. 8, the crossing zones between the inter-panel interstices 12 are covered by a bridging plate 23 arranged against the four adjacent corners of the inner plates 10 of four adjacent insulation panels 2. Such a bridging plate 23 is for example cross-shaped or square.

Furthermore, according to one embodiment, the bridging plates 22 extending beyond and in the same direction as the metal plates 17, 18 attached to the insulation panels 2 are fitted with metal plates that are attached against the inner face of said bridging plates 22 and used to anchor the secondary sealing membrane 4. This arrangement helps to ensure the continuous anchoring of the secondary sealing membrane 4 to the secondary thermal insulation barrier 1.

Figure 10:
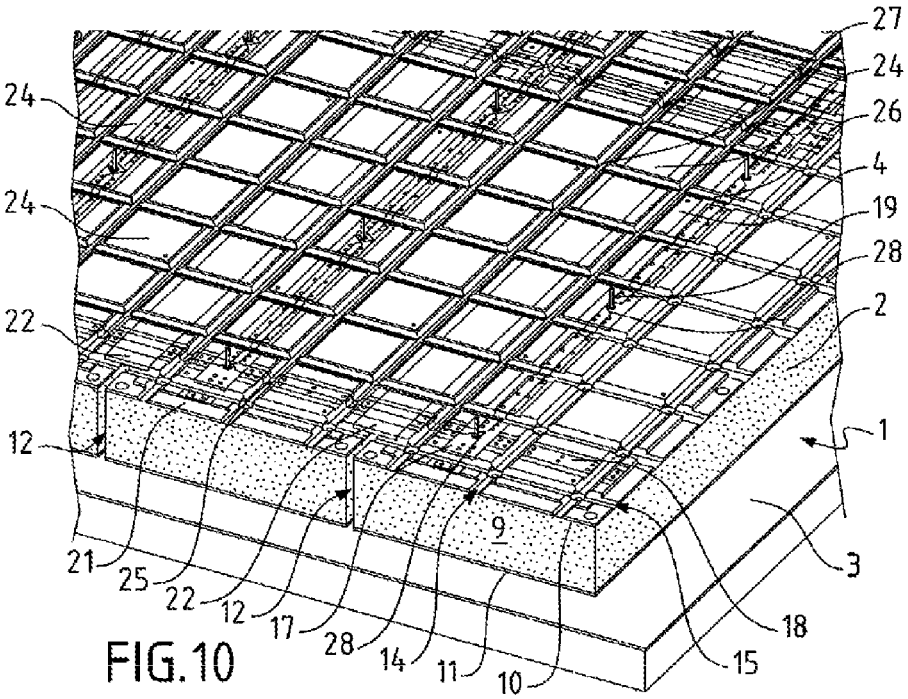
FIG. 10 is a partial perspective view showing a plurality of corrugated metal plates of the secondary sealing barrier carried by the insulation panels of the secondary thermal insulation barrier.
Figure 11:
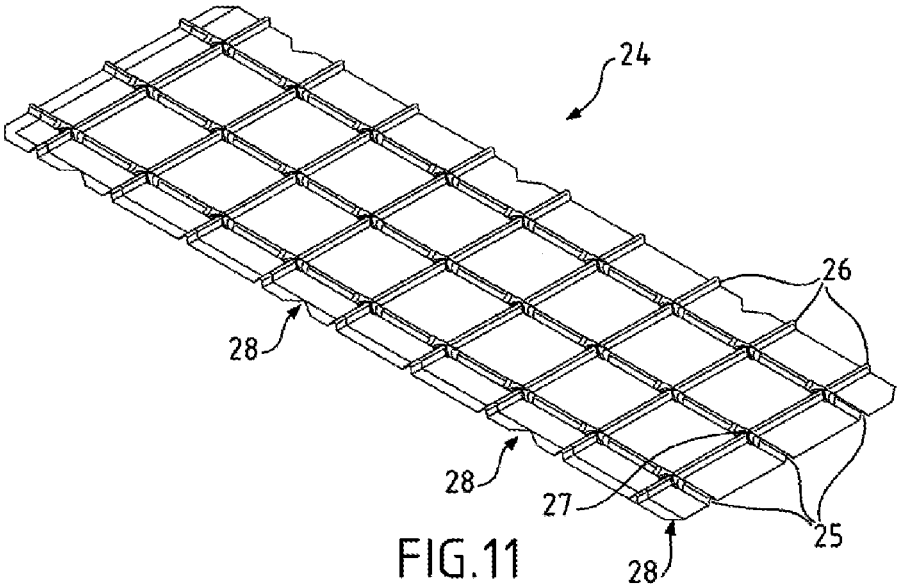
FIG. 11 is a perspective view of a corrugated metal sheet of the secondary sealing barrier.

FIGS. 10 and 11 show how the secondary sealing barrier has a plurality of corrugated metal sheets 24, each of which is substantially rectangular. The corrugated metal sheets 24 are offset in relation to the insulation panels 2 of the secondary thermal insulation barrier 1 such that each of said corrugated metal sheets 24 extends jointly over four adjacent insulation panels 2.

Each corrugated metal sheet 24 has a first series of parallel corrugations 25 extending in a first direction and a second series of parallel corrugations 26 extending in a second direction. The directions of the series of corrugations 25, 26 are perpendicular. Each of the series of corrugations 25, 26 is parallel to two opposing edges of the corrugated metal sheet 24. The corrugations 25, 26 project towards the outside of the vessel, i.e. towards the load-bearing structure 3. The corrugated metal sheet 24 has a plurality of flat surfaces between the corrugations 25, 26. The metal sheet has a node zone 27 at each crossing between two corrugations 25, 26, as shown in FIG. 11. The node zone 27 has a central portion with an apex projecting towards the inside of the vessel. Furthermore, the central portion is flanked on one side by a pair of concave corrugations formed in the peak of the corrugation 25, and on the other side by a pair of reinforcements penetrated by the corrugation 26. In the embodiment shown, the corrugations 25, 26 in the first series and in the second series are of identical height. It is nonetheless possible for the corrugations 25 in the first series to be taller than the corrugations 26 in the second series, or vice versa.

As shown in FIG. 10, the corrugations 25, 26 in the corrugated metal sheets 24 are seated in the slots 14, 15 formed in the inner plate 10 of the insulation panels 2. Adjacent corrugated metal sheets 24 are lap-welded together. The corrugated metal sheets 24 are anchored to the metal plates 17, 18 by spot welding.

The corrugated metal sheets 24 have cut-outs 28 along the longitudinal edges of same and at the four corners of same to accommodate the studs 19 used to attached the primary thermal insulation barrier 5 to the secondary thermal insulation barrier 1.

The corrugated metal sheets 24 are, for example, made of Inver®, i.e. an alloy of iron and nickel with a coefficient of expansion typically between $1.2\times10^{-6}$ and $2\times10^{-6}$ $K^{-1}$, or of an iron alloy with a high manganese content with a coefficient of expansion typically around $7\times10^{-6}$ $K^{-1}$. Alternatively, the corrugated metal sheets 24 may also be made of stainless steel or aluminum.

As shown in FIG. 2, the primary thermal insulation barrier 5 has a plurality of insulation panels 6 that are substantially rectangular parallelepipeds. In this case, the insulation panels 6 are offset in relation to the insulation panels 2 of the secondary thermal insulation barrier 1 such that each insulation panel 6 covers four insulation panels 2 of the secondary thermal insulation barrier 1.

Figure 12:
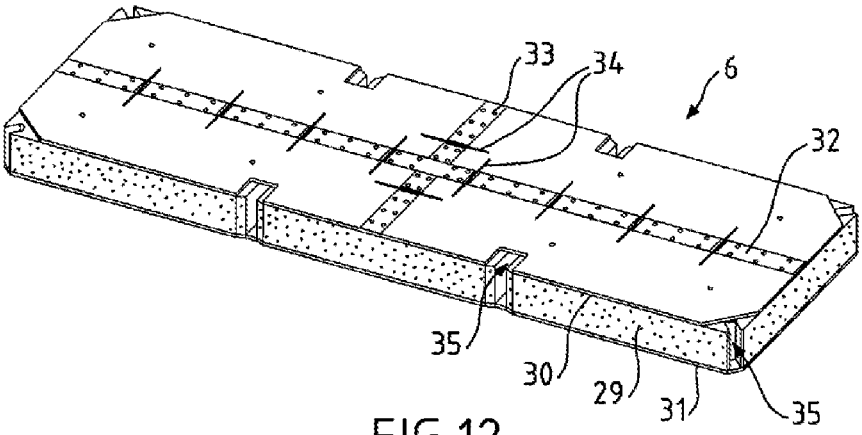
FIG. 12 is a perspective view of an insulation panel of the primary thermal insulation barrier.

An insulation panel 6 is shown in detail in FIG. 12. The structure of the panel is similar to an insulation panel 2 of the secondary thermal insulation barrier 1, i.e. a sandwich structure comprising a layer of insulating polymer foam 29 sandwiched between two rigid plates, for example made of plywood 30, 31. The inner plate 30 of an insulation panel 6 of the primary thermal insulation barrier 5 is fitted with metal plates 32, 33 to anchor the corrugated metal sheets of the primary sealing membrane 7. The metal plates 32, 33 extend in two perpendicular directions that are each parallel to two opposing edges of the insulating panels 6. The metal plates 32, 33 are attached in the recesses formed in the inner plate 30 of the insulation panel 5 and attached to same by screws, rivets or staples, for example.

Furthermore, the inner plate 30 of the insulation panel 6 is provided with a plurality of stress-relief slots 34 enabling the primary sealing membrane 7 to deform without generating excessive mechanical stresses on the insulation panels 6. Such stress-relief slots are notably described in document FR 3001945.

Figure 13:
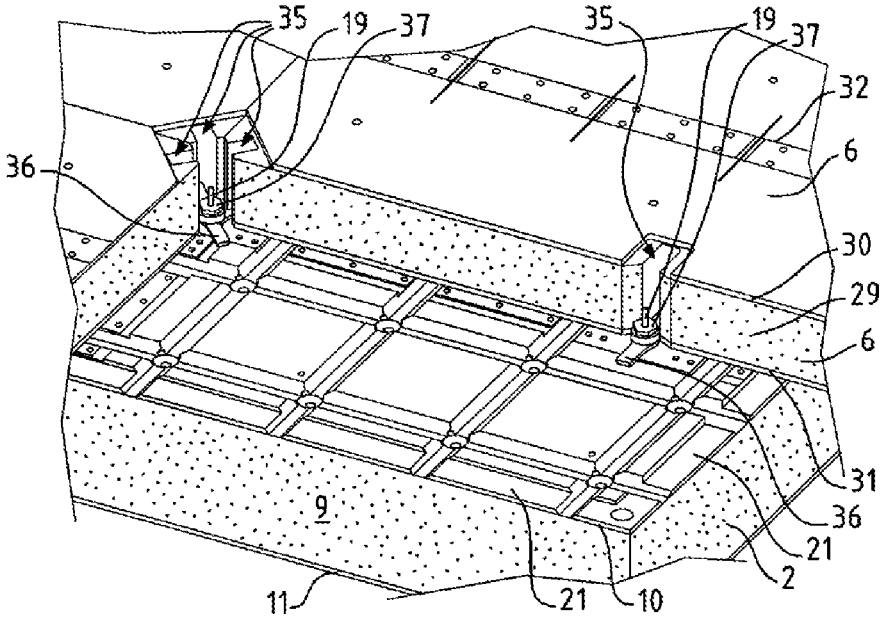
FIG. 13 is a perspective view showing the primary retaining members enabling the insulation panels of the primary thermal insulation barrier to be attached to the insulation panels of the secondary thermal insulation barrier.

In one embodiment, an insulation panel 6 of the primary thermal insulation barrier 5 can be attached to the studs 19 carried by the secondary thermal insulation barrier 1 in the manner shown in FIG. 13. The insulation panel 6 has a plurality of cut-outs 35 along the edges and at the corners of same. The outer plate 30 extends into the cut-outs 35 such as to form a bearing surface. A retaining member 36 includes feet seated inside the cut-outs 35 and bearing against the portion of the outer plate 31 penetrating the cut-out 35 such as to sandwich the outer plate 31 between a foot of the retaining member 36 and an insulation panel 2 of the secondary thermal insulation barrier 1. The retaining member 36 includes a bore that slides onto a threaded stud 19. Furthermore, a nut 37 cooperates with the thread of the threaded stud 19 to attach the retaining member 36. A Belleville washer assembly is slid onto the threaded stud 19 between the nut 37 and the retaining member 36.

Figure 14:
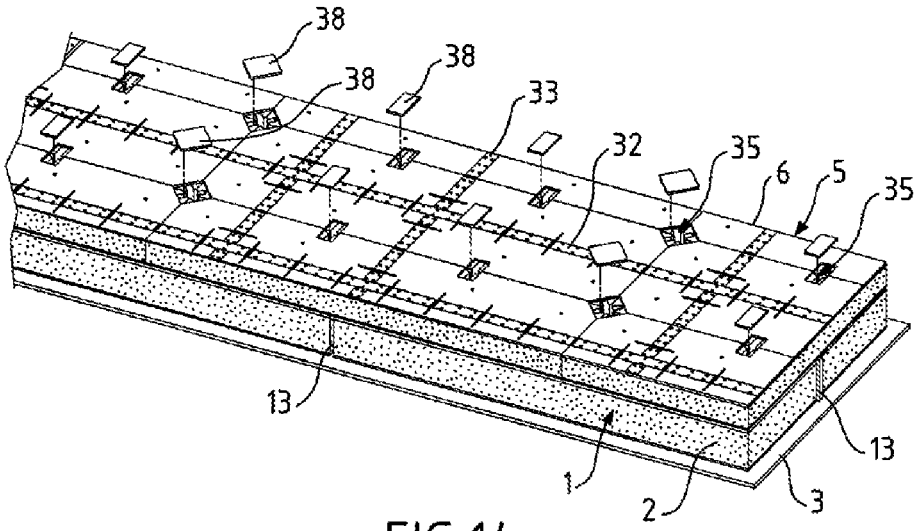
FIG. 14 is an exploded perspective view of the primary thermal insulation barrier.

Furthermore and as shown in FIG. 14, the primary thermal insulation barrier 5 has a plurality of closing plates 38 to complete the bearing surface of the primary sealing membrane 7 around the cut-outs 35. As shown in detail in FIG. 13, the cut-outs 35 are larger around the inner plate 30 than around the layer of insulating polymer foam 29, thereby forming a counterbore used to position and retain the closing plates 38. The closing plates 38 may notably be attached against the counterbore using staples.

Figure 15:
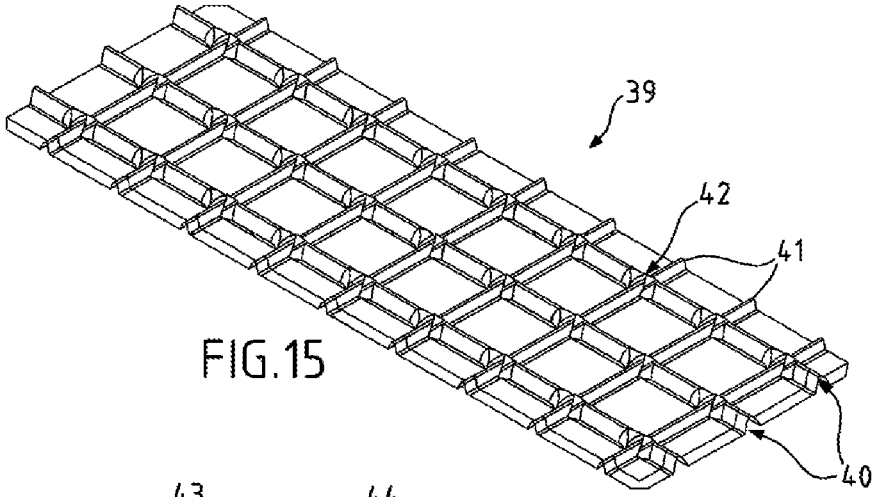
FIG. 15 is a perspective view of a corrugated metal sheet of the primary sealing membrane.

The primary sealing membrane 7 is obtained by assembling a plurality of corrugated metal sheets 39, one of which is shown in FIG. 15. Each corrugated metal sheet 39 has a first series of parallel "high" corrugations 40 extending in a first direction and a second series of parallel "low" corrugations 41 extending in a second direction perpendicular to the first series. The structure of the node zones 42 is similar to the structure of the node zones 27 of the corrugated metal sheets 24 of the secondary sealing membrane 4. The corrugations 40, 41 project towards the inside of the vessel. The corrugated metal sheets 39 are made of stainless steel or aluminum, for example.

Figure 16:
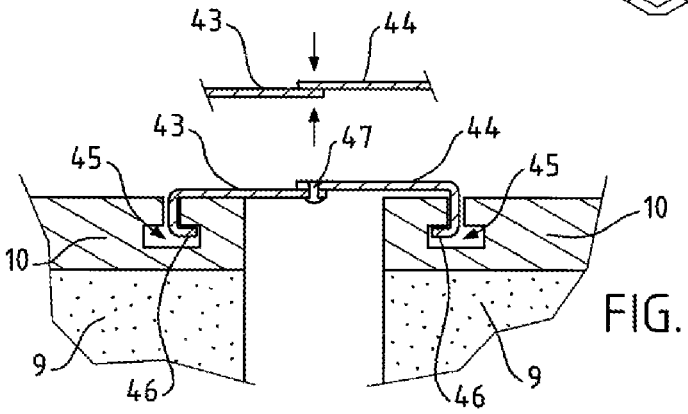
FIG. 16 is a schematic cross section of a bridging element according to a second embodiment.
Figure 17:
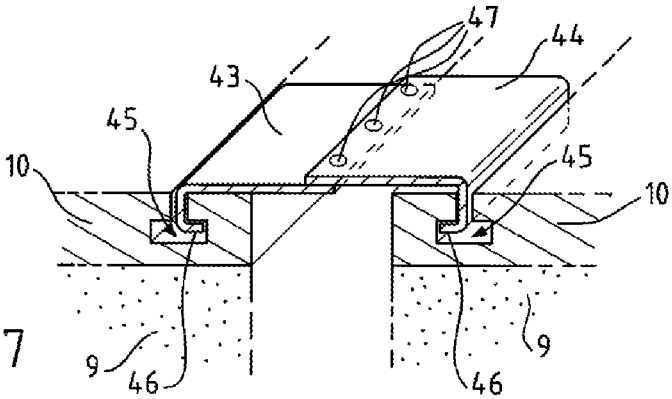
FIG. 17 is a schematic perspective view of the bridging element in FIG. 16.

FIGS. 16 and 17 show a bridging element, according to a second embodiment, straddling two insulation panels 2 of the secondary thermal insulation barrier 1. In this embodiment, each bridging element is formed by two metal plates 43, 44 that are each held in a slot 45 formed along one edge of an inner plate 10 of an insulation panel 2.

Figure 22:
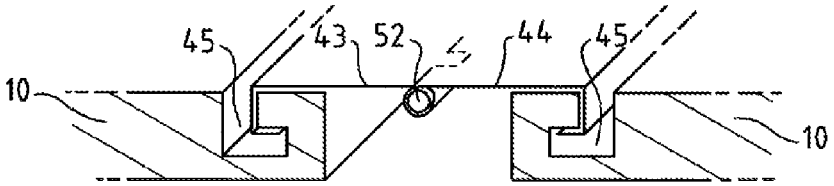
FIG. 22 is a schematic cross section of a bridging element according to a fourth embodiment.
Figure 23:
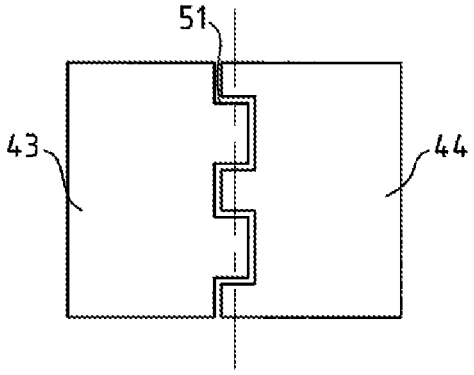
FIG. 23 is a schematic top view of the bridging element in FIG. 22.
Figure 24:
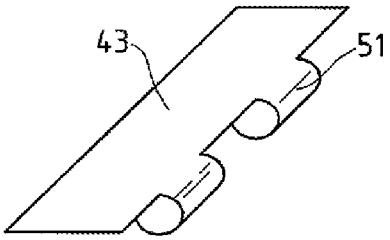
FIG. 24 is a schematic view of one of the two metal plates of the bridging element in FIGS. 22 and 23.

The slot 45 has an inverted T shape, as shown in FIGS. 16 and 17, or a J shape. One of the edges of each metal plate 43, 44 is folded over and has a flange 46 that is held inside the slot 45. The two metal plates 43, 44 are attached to one another in situ after the insulation panels 2 have been attached against the load-bearing structure 3. The two metal plates 43, 44 are attached to one another in an overlap zone using attachment members such as rivets 47. The embodiment shown in FIGS. 22, 23 and 24 differs notably from the embodiment in FIGS. 16 and 17 in the means for attaching the two metal plates 43, 44 together. The two metal plates 43, 44 have castellated edges 51 that engage with each other. The castellated edges 51 are folded such as to form hooks into which a horizontal pin 52 is inserted. Moreover, the slot 45 formed along one edge of an inner plate 10 of an insulation panel 2 to retain the metal plates 43, 44 is J-shaped.

Figure 18:
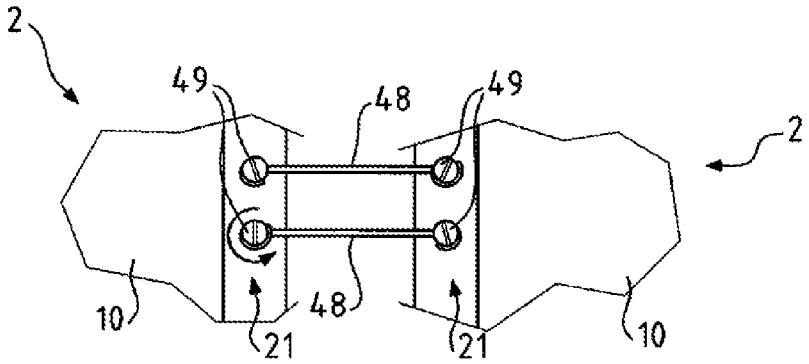
FIG. 18 is a schematic illustration of bridging elements according to a third embodiment.
Figure 19:
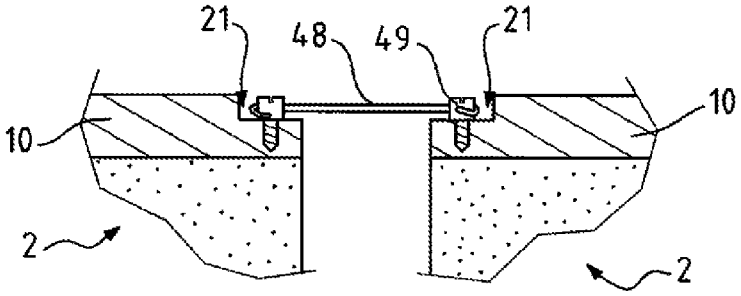
FIG. 19 is a schematic cross section of a bridging element according to the third embodiment in FIG. 18.

FIGS. 18 and 19 show a bridging element according to a third embodiment. In this embodiment, the bridging elements are metal wires 48 that are attached to the screws 49 that are attached to the edges of the inner plates 10 of two adjacent insulation panels 2. The inner plate 10 also has recesses 21 along the edges of same, the inside of said recesses receiving the screws 49 such that the heads of the screws 49 do not protrude beyond the bearing surfaces of the inner plate 10 and are therefore not liable to damage the corrugated metal sheets 24 of the secondary sealing membrane 4. Alternatively, the bridging elements are made of flexible elements, such as blades, the ends of which are attached to the screws inserted in the edges of the inner plate of two adjacent insulation panels.

Figure 21:
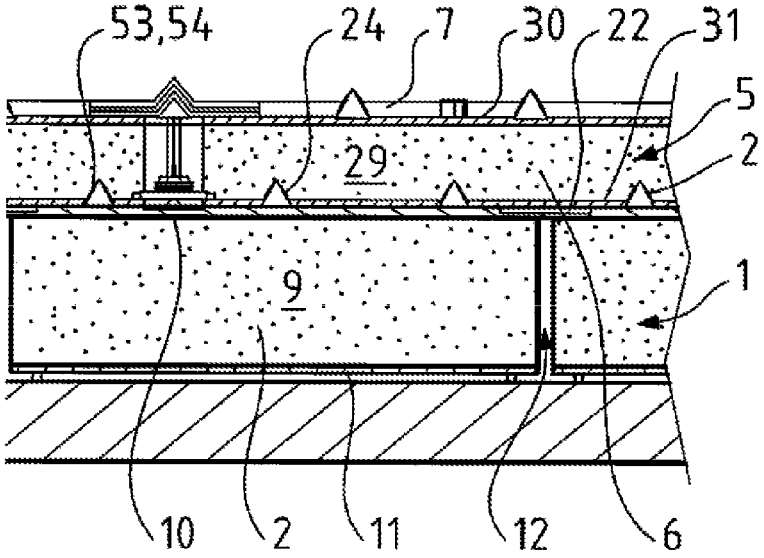
FIG. 21 is a cross section of a wall of a sealed and thermally insulated vessel for storing a fluid according to another embodiment.

In the embodiment shown in FIG. 21, the corrugated metal sheets 24 of the secondary sealing barrier 4 have corrugations 53 projecting towards the inside of the vessel, unlike the corrugations in the previous embodiments. The corrugated metal sheets 24 of the secondary sealing barrier also have two series of perpendicular corrugations. As in the previous embodiments, the corrugated metal sheets are attached to the inner plate of the insulation panels of the secondary sealing membrane using metal plates (not shown) that extend in two perpendicular directions and are attached to the inner plate 10 of the insulation panels 2.

However, in this embodiment, the outer plate 30 of the insulation panels 6 of the primary thermal insulation barrier 5 have two series of slots that are arranged perpendicular to one another such as to form a network of slots. The slots 54 are thus designed to receive the corrugations 53 projecting towards the inside of the vessel and formed on the corrugated metal sheets 24 of the secondary sealing barrier 4.

Figure 20:
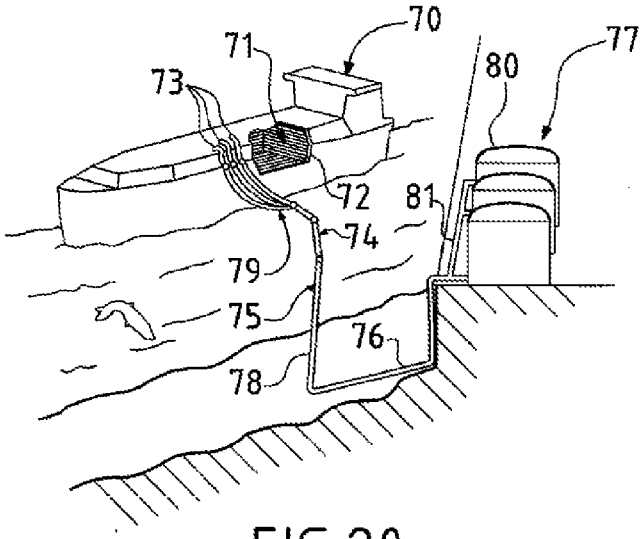
FIG. 20 is a cut-away schematic view of an liquefied natural gas carrier ship vessel and of a loading/offloading terminal for this vessel.

With reference to FIG. 20, a cut-away view of an liquefied natural gas carrier ship 70 shows a sealed and insulating vessel 71 having an overall prismatic shape mounted in the double hull 72 of the ship. The wall of the vessel 71 has a primary sealing membrane designed to be in contact with the LNG contained in the vessel, a secondary sealing membrane arranged between the primary sealing membrane and the double hull 72 of the ship, and two insulating barriers arranged respectively between the primary sealing membrane and the secondary sealing membrane and between the secondary sealing membrane and the double hull 72.

In a known manner, the loading/offloading pipes 73 arranged on the upper deck of the ship can be connected, using appropriate connectors, to a sea or port terminal to transfer a cargo of LNG to or from the vessel 71.

FIG. 20 shows an example sea terminal comprising a loading/offloading point 75, an underwater duct 76 and an onshore facility 77 The loading/offloading point 75 is a fixed offshore installation comprising a movable arm 74 and a column 78 holding the movable arm 74. The movable arm 74 carries a bundle of insulated hoses 79 that can connect to the loading/offloading pipes 73. The orientable movable arm 74 can be adapted to all sizes of liquefied natural gas carrier ships. A linking duct (not shown) extends inside the column 78. The loading/offloading point 75 makes loading and offloading of the liquefied natural gas carrier ship 70 possible to or from the onshore facility 77. This facility has liquefied gas storage vessels 80 and linking ducts 81 connected via the underwater duct 76 to the loading/offloading point 75. The underwater duct 76 enables liquefied gas to be transferred between the loading/offloading point 75 and the onshore facility 77 over a large distance, for example 5 km, which makes it possible to keep the liquefied natural gas carrier ship 70 a long way away from the coast during loading and offloading operations.

To create the pressure required to transfer the liquefied gas, pumps carried on board the ship 70 and/or pumps installed at the onshore facility 77 and/or pumps installed at the loading/offloading point 75 are used.

Although the invention has been described in relation to several specific embodiments, it is evidently in no way limited thereto and it includes all of the technical equivalents of the means described and the combinations thereof where these fall within the scope of the invention, as defined in the claims.

Use of the verb "comprise" or "include", including when conjugated, does not exclude the presence of other elements or other steps in addition to those mentioned in a claim. Use of the indefinite article "a" or "one" for an element or a step does not exclude, unless otherwise specified, the presence of a plurality of such elements or steps.

In the claims, reference signs between parentheses should not be understood to constitute a limitation to the claim.

The invention claimed is:

1. A sealed and thermally insulated vessel for storing a fluid, comprising a secondary thermal insulation barrier comprising insulation panels held against a load-bearing structure and anchored to same by secondary retaining members, a secondary sealing membrane carried by the insulation panels of the secondary thermal insulation barrier, a primary thermal insulation barrier anchored against the secondary sealing membrane by primary retaining members and a primary sealing membrane carried by the primary thermal insulation barrier and designed to be in contact with a cryogenic fluid contained in the vessel;

the secondary sealing membrane comprising a plurality of corrugated metal sheets sealingly welded to one another, each having at least two perpendicular corrugations;

the insulation panels of the secondary thermal insulation barrier being juxtaposed, each insulation panel having an inner face opposite the load-bearing wall, said inner face being fitted with metal plates onto which the corrugated metal sheets are welded; and each insulation panel being associated with adjacent insulating panels by means of a plurality of bridging elements, each bridging element being arranged to straddle at least two adjacent insulating panels and being attached firstly to one edge of the inner face of one of the two insulation panels and secondly to an edge of the inner face of the other insulation panel such as to prevent the adjacent insulation panels from moving apart from one another, said edges of the inner faces of each of the adjacent insulating panels facing one another.

2. The vessel as claimed in claim 1, in which the corrugations of the corrugated metal sheets of the secondary sealing membrane project towards the outside of the vessel and towards the load-bearing structure, the inner face of the insulation panels of the secondary thermal insulation barrier having perpendicular slots designed to receive the corrugations of the corrugated metal sheets.

3. The vessel as claimed in claim 1, in which the corrugations of the corrugated metal sheets of the secondary sealing membrane project towards the inside of the vessel, the primary thermal insulation barrier having insulation panels, each of which has an outer face with perpendicular slots designed to receive the corrugations of the corrugated metal sheets of the secondary sealing membrane.

4. The vessel as claimed in claim 1, in which the bridging elements are bridging plates that each have an outer face bearing against the inner face of each of the adjacent insulation panels and an inner face carrying the secondary sealing membrane.

5. The vessel as claimed in claim 4, in which the inner face of the insulation panels has recesses formed along the edges of said inner face, and the bridging plates are attached to the inside of said recesses.

6. The vessel as claimed in claim 4, in which the bridging plates are attached by bonding, screwing and/or stapling against the inner face of each of the two adjacent insulation panels.

7. The vessel as claimed in claim 4, in which the bridging plates are made of plywood.

8. The vessel as claimed in claim 2, in which each insulation panel has a rectangular parallelepiped shape and has an inner face including two series of slots designed to receive the corrugations of the corrugated metal sheets each of the two series of slots being perpendicular to the other series and to two opposite sides of the insulation panel, the plurality of bridging elements including, along each edge of the inner surface of each insulation panel, a bridging element arranged in each gap between two consecutive slots in the series of slots perpendicular to said edge.

9. The vessel as claimed in claim 2, in which each insulation panel has a rectangular parallelepiped shape and has an inner face including two series of slots designed to receive the corrugations of the corrugated metal sheets, each of the two series of slots being perpendicular to the other series and to two opposite sides of the insulation panel, the plurality of bridging elements including, along each edge of the inner surface of each insulation panel, a bridging element having a series of slots extending the series of slots perpendicular to said edge.

10. The vessel as claimed in claim 9, in which the bridging element comprising a series of slots extending the series of slots perpendicular to said edge also includes a slot perpendicular to said series of slots.

11. The vessel as claimed in claim 1, in which a bridging element includes an elongate element that is rigidly attached to two attachment members attached respectively to each of the two adjacent insulation panels.

12. The vessel as claimed in claim 1, in which a bridging element is formed by two metal plates each having a folded edge forming a flange, the flanges being respectively held inside a slot formed in the inner face of each of the two adjacent insulation panels, the two metal plates being attached together by attachment members.

13. The vessel as claimed in claim 1, in which each insulation panel has a layer of insulating polymer foam and a rigid inner plate forming the inner face of said insulation panel.

14. The vessel as claimed in claim 1, in which the insulating panels are separated from one another by interstices, the secondary thermal insulation barrier having an insulating blanket arranged in the interstices.

15. The vessel as claimed in claim 14, in which the insulating blanket arranged in the interstices between the insulation panels is a porous blanket designed to allow gas to flow through the interstices.

16. The vessel as claimed in claim 1, in which the primary sealing membrane has a plurality of corrugated metal sheets welded to one another and each having at least two perpendicular corrugations projecting towards the inside of the vessel, and in which the primary thermal insulation barrier has a plurality of juxtaposed insulation panels, each insulation panel having an inner face fitted with metal plates onto which the corrugated metal sheets of the primary sealing membrane are welded.

17. A ship used to transport a fluid, the ship having a double hull and a vessel as claimed in claim 1, placed inside the double hull.

18. A method for loading or offloading a ship as claimed in claim 17, in which a fluid is channeled through insulated pipes to or from an onshore or floating storage facility to or from the vessel on the ship.

19. A transfer system for a fluid, the system including a ship as claimed in claim 17, insulated pipes arranged to connect the vessel installed in the hull of the ship to an onshore or floating storage facility and a pump for driving a fluid through the insulated pipes to or from the onshore or floating storage facility to or from the vessel on the ship.

* * * * *